US005816829A

United States Patent [19]

Chiang

[11] Patent Number: 5,816,829

[45] Date of Patent: Oct. 6, 1998

[54] ELECTRICAL CONNECTOR HAVING ARRAYS OF TERMINALS FOR A MULTI-CONDUCTOR CABLE

[75] Inventor: Kan-Chun Chiang, Keelung, Taiwan

[73] Assignee: Ulan Co., Ltd., Taichung, Taiwan

[21] Appl. No.: 910,728

[22] Filed: Aug. 13, 1997

[51] Int. Cl.[6] ..... H01R 9/09

[52] U.S. Cl. ..... 439/76.1; 439/77

[58] Field of Search ..... 439/76.1, 77, 78

[56] References Cited

U.S. PATENT DOCUMENTS

| | | | |
|---|---|---|---|
| 3,865,454 | 2/1975 | Blinder | 439/78 |
| 4,889,497 | 12/1989 | Riches | 439/76.1 |
| 5,061,193 | 10/1991 | Seaman | 439/76.1 |

*Primary Examiner*—P. Austin Bradley
*Assistant Examiner*—T. C. Patel
*Attorney, Agent, or Firm*—Ladas & Parry

[57] ABSTRACT

An electrical connector for connecting multiconductor cable includes a dielectric terminal seat and a plurality of male terminals. The male terminals are arranged in intersecting rows, and have contact pin portions and leg portions which project from two sides of the dielectric terminal seat, respectively. A printed circuit board is formed with a plurality of conducting indentations in its peripheral end, a plurality of conducting slots when are surrounded by the conducting indentations for making electrical connection with respective ones of the leg portions when the leg portions are inserted therein, and conducting lines for electrically interconnecting the conducting slots and the conducting indentations. Thus, each indentation facilitates locating and making a soldered electrical connection with a respective one of the wire conductors of the cable.

4 Claims, 3 Drawing Sheets

ELECTRICAL CONNECTOR HAVING ARRAYS OF TERMINALS FOR A MULTI-CONDUCTOR CABLE

BACKGROUND OF THE INVENTION

1. Field of the Invention

This invention relates to an electrical connector with arrays of terminals for a multiconductor cable, more particularly to a cable connector for electrical connection with a mating connecting portion of a computer.

2. Description of the Related Art

Referring to FIG. 1, in a conventional method for assembling a cable connector, a plurality of male terminals 16 are arranged in intersecting rows and are mounted to a dielectric terminal seat 10. Contact pin portions 11 of the male terminals 16 project from one side of the terminal seat 10 and pass respectively through guide holes 121 of a dielectric connector body 12. Leg portions 13 of the male terminals 16 project from the other side of the terminal seat 10, and are soldered respectively to a plurality of wire conductors 14*a* of a cable 14. A rear housing 15 is used to cover the leg portions 13 and the wire conductors 14*a*. One drawback of the aforementioned conventional method resides in that the soldered connection between each leg portion 13 and the corresponding wire conductor 14*a* can not be made easily because the leg portions 13 are densely arranged in a limited space and thus, good eyesight and careful attention are required to properly solder each leg portion 13 to the corresponding wire conductor 14*a*. Inferior products with unacceptable soldered connection are easily encountered due to the closely adjacent leg portions 13.

SUMMARY OF THE INVENTION

The main object of the present invention is to provide an electrical connector, such as a cable connector with a cable connecting member through which arrays of terminals of the electric connector can be conveniently soldered to the wire conductors of a cable. The connecting member is the form of a printed circuit board which can be easily located and soldered.

According to this invention, an electrical connector for connecting with a plurality of wire conductors of a cable includes a dielectric terminal seat and a plurality of male terminals. The male terminals are arranged in intersecting rows, and have contact pin portions and leg portions which project from two sides of the dielectric terminal seat, respectively. A printed circuit board is formed with a plurality of conducting indentations in its peripheral end, a plurality of conducting slots which are surrounded by the conducting indentations for making electrical connection with respective ones of the leg portions when the leg portions are inserted therein, and conducting lines for electrically interconnecting the conducting slots and the conducting indentations. Thus, each indentation facilitates locating and making a soldered electrical connection with a respective one of the wire conductors of the cable.

BRIEF DESCRIPTION OF THE DRAWINGS

Other features and advantages of the present invention will become apparent in the following detailed description of a preferred embodiment of the invention, with reference to the accompanying drawings, in which.

DETAILED DESCRIPTION OF THE PREFERRED EMBODIMENT

Figure 1:
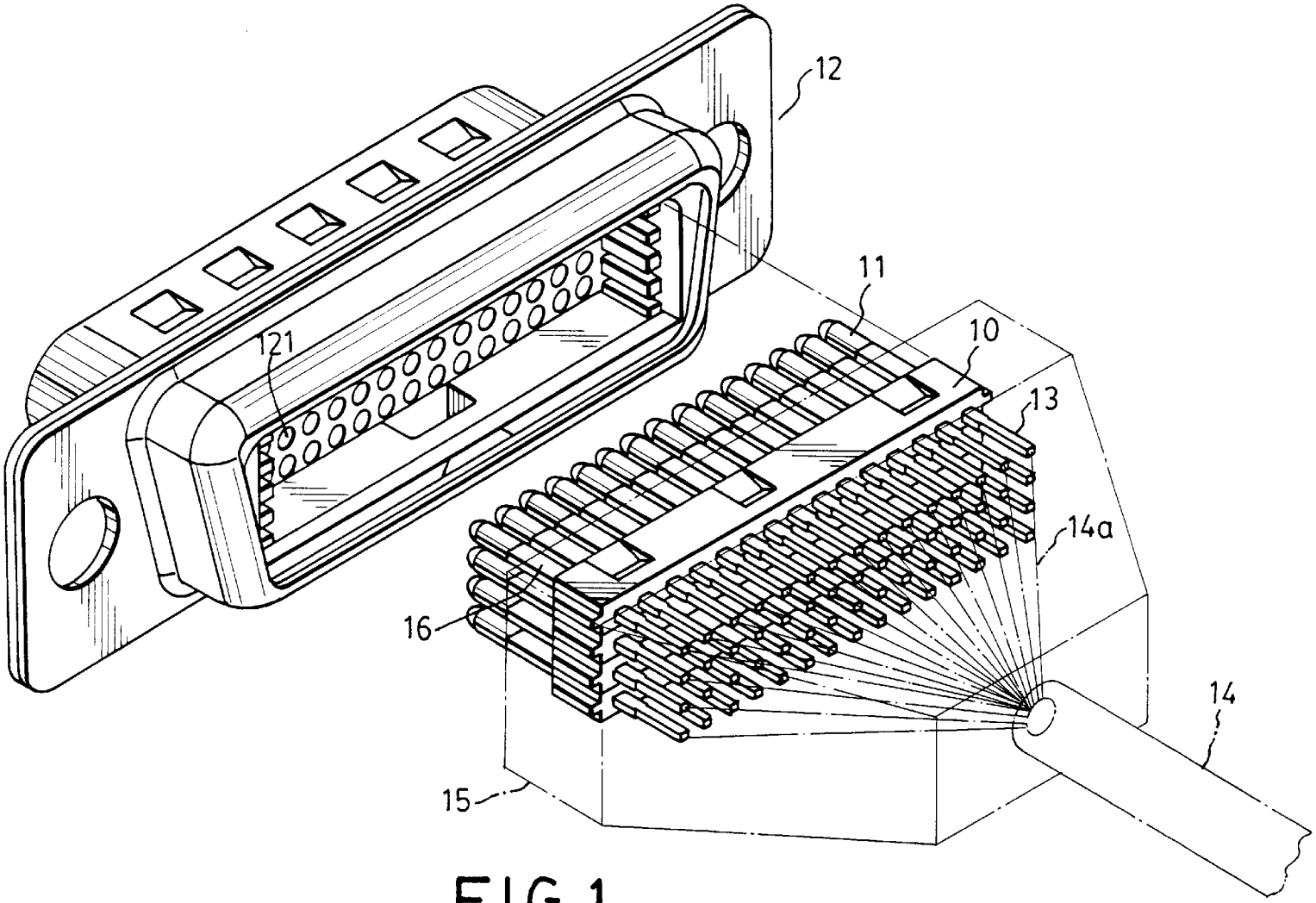
FIG.1 PRIOR ART
FIG. 1 is an exploded view of a conventional cable connector.
Figure 2:
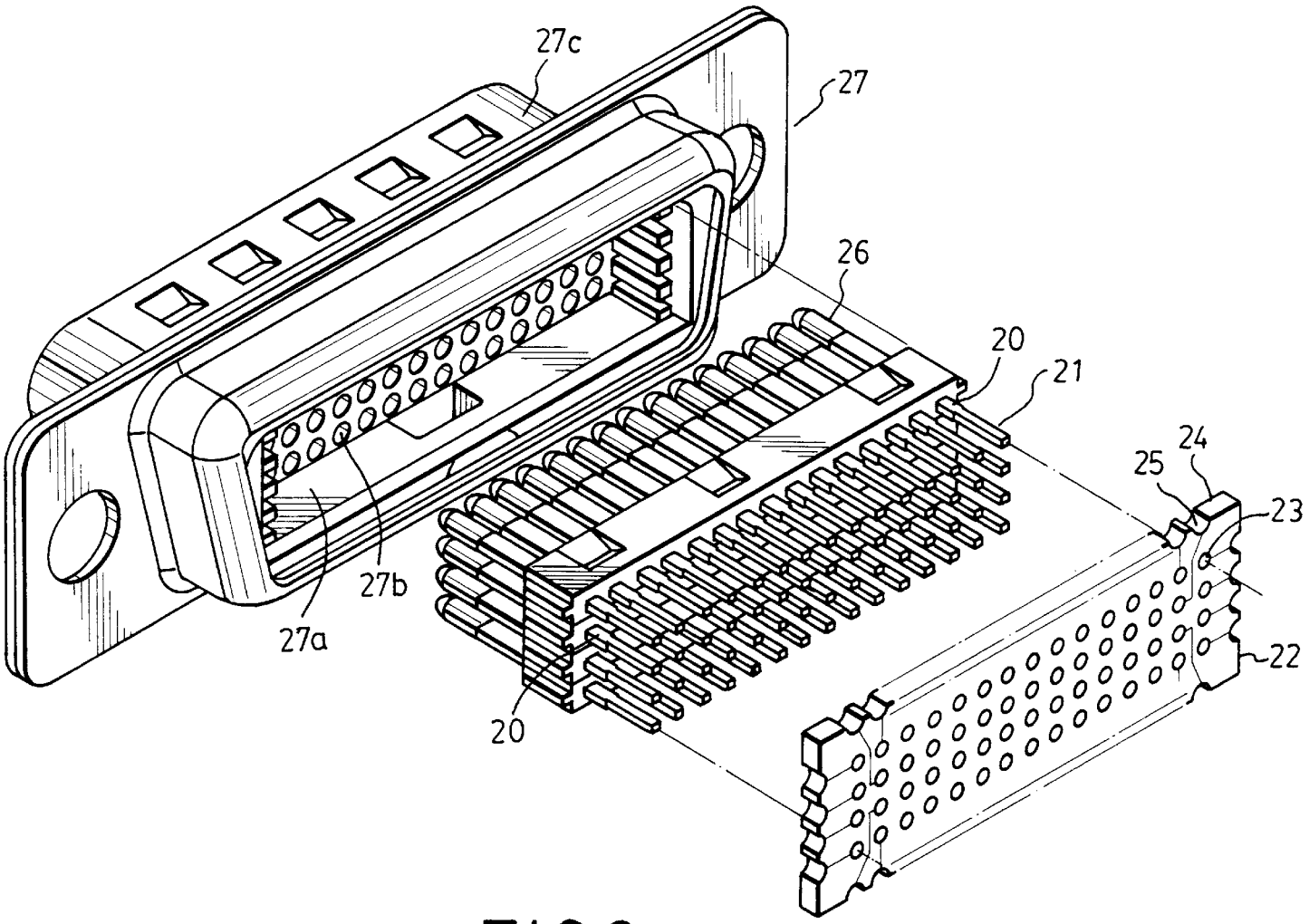
FIG. 2 is an exploded view of a preferred embodiment of a cable connector according to the present invention.
Figure 3:
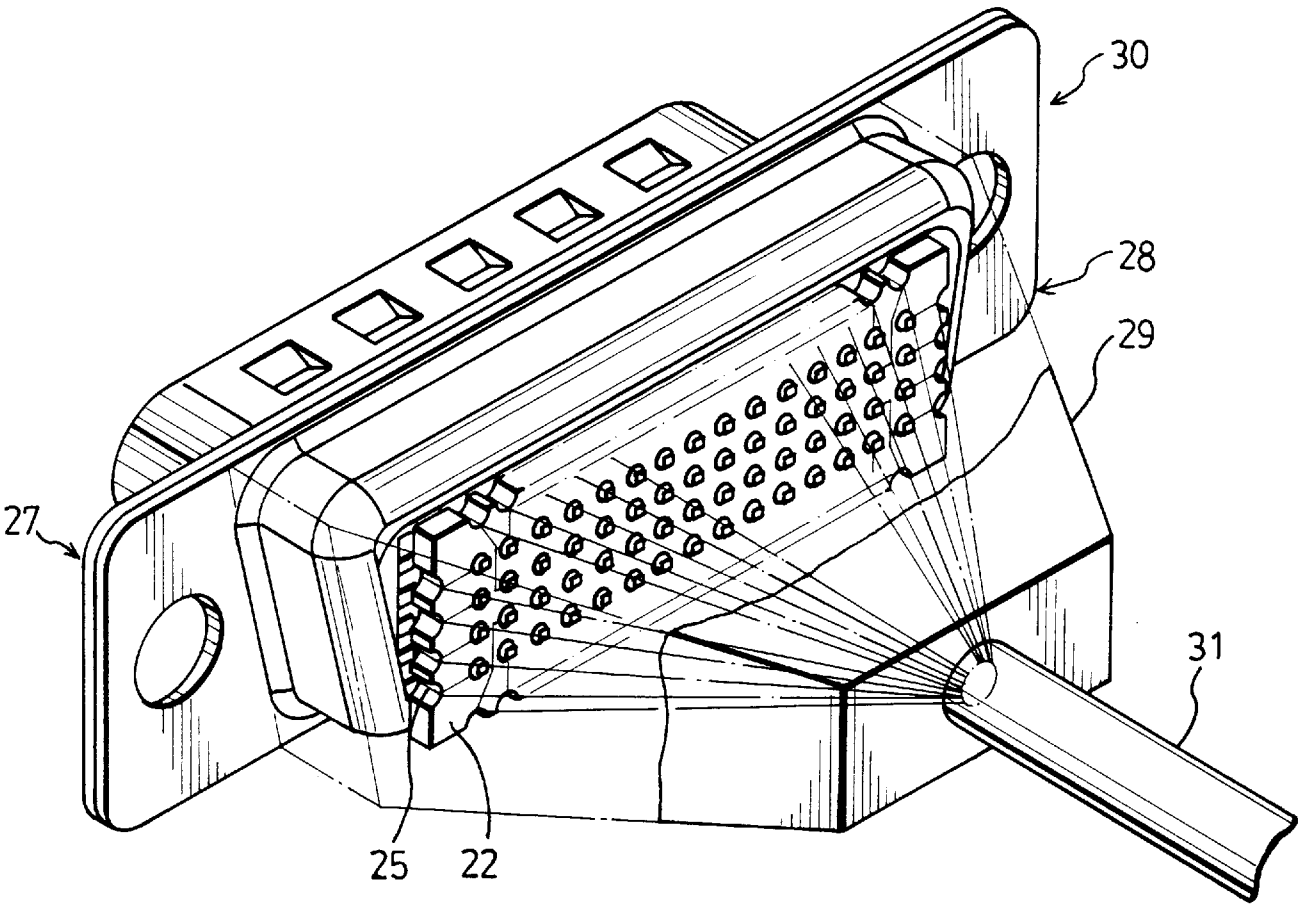
FIG. 3 is a perspective view of the cable connector.

Referring to FIGS. 2 and 3, the preferred embodiment of a cable connector 30 for a cable 31 in accordance with the present invention is shown to comprise a dielectric terminal seat 29*a*, a plurality of male terminals 20 which are mounted to the dielectric terminal seat 29*a* and which are arranged in intersecting rows, a printed circuit board 22, a dielectric connector body 27, and a rear covering 29.

The male terminals 20 hare contact pin portions 26 which project forwardly from one side of the dielectric terminal seat 29*a*, and leg portions 21 which project rearwardly from an opposite side of the dielectric terminal seat 29*a*.

The printed circuit board 22 is rectangular and includes four edges at a peripheral end 24 thereof. The peripheral end 24 is formed with a plurality of conducting indentations, such as conducting notches 25 which are formed along the peripheral end 24. Alternatively, the conducting indentations may be in the form of holes (not shown). The printed circuit board 22 further has a plurality of conducting slots 23 which are surrounded by the conducting notches 25 and which are arranged in intersecting rows, and conducting lines (not shown) for electrically connecting the conducting slots 23 to the respective conducting notch 25.

The dielectric connector body 27 has a cavity 27*a*, a plurality of guide holes 27*b* for passage of the contact pin portions 26 of the male terminals 20, and a front mating portion 27*c* which shields the forwardly projecting contact pin portions 26.

As best shown in FIG. 3, the rear covering 29 is an injection molded plastic body and is formed at the rear side of the dielectric connector body 27 to encapsulate the leg portions 21 and the printed circuit board 22.

The cable 31 has a plurality of wire conductors 31*a* which are led to the peripheral end 24 of the printed circuit board 22 so as to be soldered to the corresponding conducting notch 25.

In assembly, the leg portions 21 of the male terminals 20 are fittingly inserted into the conducting slots 23 of the printed circuit board 22. Then the contact pin portions 26 pass through the corresponding guide holes 27*b* so that the terminal seat 29*a* is received in the cavity 27*a*. Subsequently, the wire conductors 31*a* of the cable 31 are soldered to the respective conducting notch 25 so that each conducting notch 25 makes a soldered electric connection with the respective wire conductor 31*a*. Finally, the rear covering 29 is formed at the rear side of the connector body 27 by injection molding to encapsulate the leg portions 21, the printed circuit board 22 and the wire conductors 31*a*.

According to the present invention, due to the presence of the printed circuit board 22 and the conducting notches 25 which are formed along the peripheral end 24 of the printed circuit board 22, the soldered electric connection between each wire conductor 31*a* and the corresponding conducting notch 25 can be easily made and located.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An electrical connector for connecting with a plurality of wire conductors of a cable comprising:

a dielectric terminal seat;

a plurality of male terminals mounted to said dielectric terminal seat and arranged in intersecting rows, said male terminals having contact pin portions that project forwardly from one side of said dielectric terminal seat, and leg portions that project rearwardly from an opposite side of said dielectric terminal seat; and a cable connecting member including a printed circuit board which has a peripheral end formed with a plurality of conducting indentations, said printed circuit board further including a plurality of conducting slots which are surrounded by said conducting indentations and which are adapted for making electrical connection with respective ones of said leg portions when said leg portions are inserted therein, respectively, and conducting lines for electrically interconnecting said conducting slots and said conducting indentations, thereby electrically connecting said leg portions to said conducting indentations, respectively, each of said conducting indentations being adapted for locating and making a soldered electrical connection with a respective one of the wire conductors of the cable.

2. The electrical connector according to claim 1, wherein said printed circuit board is rectangular and includes four edges at said peripheral end, said conducting indentations being conducting notches which are formed along said four edges, said conducting slots being arranged in intersecting rows.

3. A cable connector for electrical connection with a mating connecting portion of a computer, said cable connector comprising:

a dielectric terminal seat;

a plurality of male terminals mounted to said dielectric terminal seat and arranged in intersecting rows, said male terminals having contact pin portions that project forwardly from one side of said dielectric terminal seat, and leg portions that project rearwardly from an opposite side of said dielectric terminal seat;

a cable connecting member including a printed circuit board which has a peripheral end formed with a plurality of conducting indentations, said printed circuit board further including a plurality of conducting slots which are surrounded by said conducting indentations and which are adapted for making electrical connection with respective ones of said leg portions when said leg portions are inserted therein, respectively, and conducting lines for electrically interconnecting said conducting slots and said conducting indentations, thereby electrically connecting said leg portions to said conducting indentations, respectively;

a dielectric connector body having a cavity for receiving said terminal seat, a plurality of guide holes for passage of said contact pin portions of said male terminals, and a front mating portion which shields said contact pin portions;

a cable having a plurality of wire conductors for electrical connection with said leg portions respectively, said wire conductors extending to said peripheral end of said printed circuit board and being soldered to said conducting indentations, respectively; and a covering which is connected to said connector body to cover said leg portions, said printed circuit board, and a portion of said cable.

4. The cable connector according to claim 3, wherein said printed circuit board is rectangular and includes four edges at said peripheral end, said conducting indentations being conducting notches which are formed along said four edges, said conducting slots being arranged in intersecting rows.

* * * * *